United States Patent [19]

Okura

[11] 4,271,335

[45] Jun. 2, 1981

[54] PICKUP CARTRIDGE HAVING A RESILIENT BIASING MEMBER FOR HOLDING AN ELONGATED STYLUS HOLDER AGAINST A SUPPORT SURFACE THEREOF

[75] Inventor: Keniti Okura, Tokorozawa, Japan

[73] Assignee: Pioneer Electronic Corporation, Tokyo, Japan

[21] Appl. No.: 930,650

[22] Filed: Aug. 3, 1978

[30] Foreign Application Priority Data

Aug. 3, 1977 [JP] Japan ..... 52-92482
Sep. 16, 1977 [JP] Japan ..... 52-110455

[51] Int. Cl.[3] ..... H04R 11/12
[52] U.S. Cl. ..... 369/136; 369/72; 369/149; 369/170; 369/256
[58] Field of Search ..... 179/100.41 K, 100.41 M, 179/100.41 D, 100.41 Z; 274/37

[56] References Cited

U.S. PATENT DOCUMENTS

| | | | |
|---|---|---|---|
| 2,820,854 | 1/1958 | Woodworth | 274/37 |
| 3,077,522 | 2/1963 | Gunter, Jr. et al. | 179/100.41 K |
| 3,088,000 | 4/1963 | Dally | 179/100.41 Z |
| 3,297,831 | 1/1967 | Stanton | 179/100.41 K |
| 3,383,474 | 5/1968 | Kriebel et al. | 179/100.41 K |
| 3,420,534 | 1/1969 | Miller | 274/37 |

FOREIGN PATENT DOCUMENTS

| | | | |
|---|---|---|---|
| 1112130 | 5/1968 | United Kingdom | 274/37 |

*Primary Examiner*—Raymond F. Cardillo, Jr.
*Attorney, Agent, or Firm*—Armstrong, Nikaido, Marmelstein & Kubovcik

[57] ABSTRACT

An improved type of pickup cartridge comprising a stylus assembly, a cartridge body case to receive the stylus assembly therein, and pole pieces provided to support the stylus assembly in the cartridge body case, wherein a resilient member is provided in the cartridge body case to secure the friction fit of the stylus assembly. The resilient member is also grounded such that the noise due to electrostatic discharge is prevented.

6 Claims, 7 Drawing Figures

PICKUP CARTRIDGE HAVING A RESILIENT BIASING MEMBER FOR HOLDING AN ELONGATED STYLUS HOLDER AGAINST A SUPPORT SURFACE THEREOF

BACKGROUND OF THE INVENTION

This invention relates to the improvement of a stereo record signal pickup cartridge, especially a moving magnet pickup cartridge, in which a stylus can be replaced.

Generally, a stylus assembly used in a moving magnet pickup cartridge consists of a knob mounted on the cartridge body case, a holder fixed to the knob, a cantilever resiliently supported in the holder together with a magnet, and a stylus mounted at the tip of the cantilever.

It is known that the noise due to electrostatic discharging it liable to be generated when the stylus assembly is not grounded, and to prevent the noise, the holder has been grounded by way of pole pieces having coils thereon. However, in the method where the holder is grounded by contacting it with the pole pieces, defective contact due to incorrect dimensions of the molded pole pieces, or the former holder, or clearance between the pipe holder and pole pieces developed by insertion and removal of the pipe holder is often observed.

Furthermore, the space surrounded by the pole pieces must be small enough to prevent defective contact which, however, makes insertion and removal of the holder difficult and, possibly, causes damage to the holder and the coils.

SUMMARY OF THE INVENTION

An object of the present invention is to juxtapose a grounding leaf spring with the holder so that grounding of the holder is ensured, thus providing a pickup cartridge which can prevent electrostatic noise generation.

Another object of the present invention is to make production inexpensive and easy, since the dimension of the space surrounded by the pole pieces in which the holder is inserted does not need high accuracy, and also to make insertion and removal of the holder easy, thus providing a pickup cartridge with a stylus and holder which can quickly and easily be replaced without causing damage to the holder and the coils.

In order to realize the above-mentioned objects, there is provided a pickup cartridge including a stylus assembly having a stylus, a cantilever carrying the stylus on its one end portion, and an elongated holder for holding said cantilever at its other end portion; a cartridge body case; pole piece means provided inside of said cartridge and having at least two coils wound therearound and at least one support surface to define a socket space to telescopically receive said elongated holder: wherein said cartridge body case is provided with a resilient member, said member projecting inside of said support surfaces.

In another aspect of the invention, there is provided a pickup cartridge comprising a stylus assembly having a cantilever carrying a stylus on its one end portion, and an elongated holder for holding said cantilever at its other end portion; a cartridge including an L-shaped base member consisting of a horizontal section and a vertical section, said vertical section having an aperture at a lower portion wherein the horizontal section and the vertical section intersect, said horizontal section having a V-shaped groove at its center line portion extending from said aperture, said V-shaped groove defining a socket space and having guide grooves in both slopes thereof; a pair of first pole pieces extending substantially in parallel with the horizontal section and having their one end molded into the vertical section; a pair of coils engaged around the first pole pieces; a pair of second pole pieces, each pole piece being U-shaped and having one leg inserted into one of the two guide grooves: wherein said cartridge is provided with a resilient member extending from the upper periphery of said aperture and having at least one lug portion protruding downward to resiliently press the inserted holder for securing a friction fit of the stylus assembly.

BRIEF DESCRIPTION OF THE DRAWINGS

These and other objects and advantages of the present invention will be easily understood from the following description of the embodiments with the reference to the accompanying drawings in which.

DETAILED DESCRIPTION OF THE PREFERRED EMBODIMENTS

Figure 1:
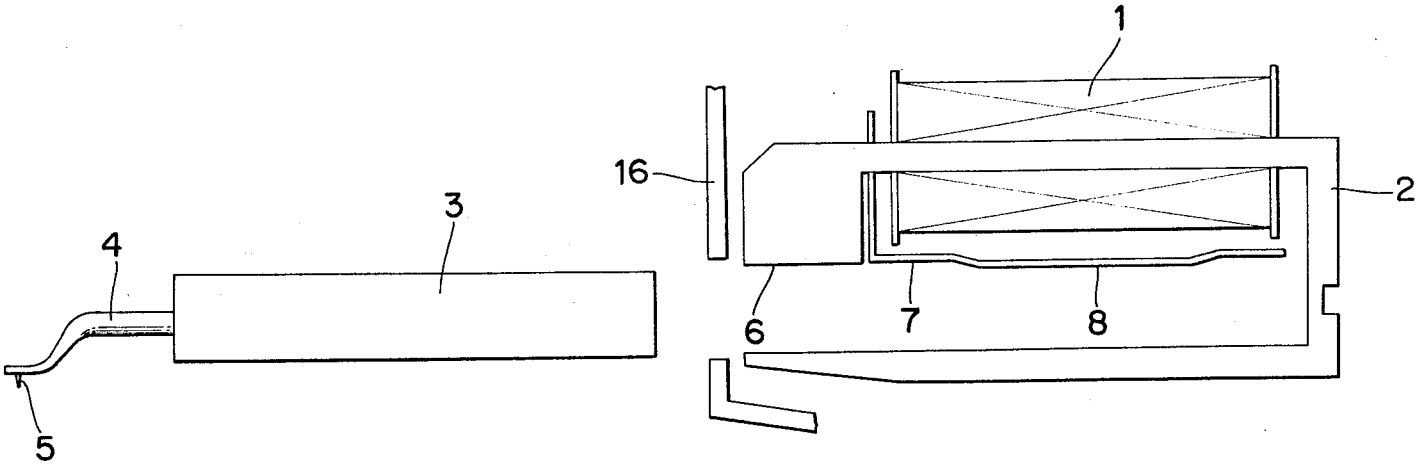
FIG. 1 is a schematic side view of one embodiment of the pickup cartridge according to the present invention.
Figure 2:
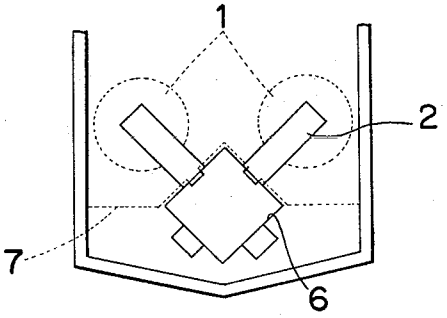
FIG. 2 is a schematic front view of the pickup cartridge of FIG. 1, wherein the stylus assembly is removed.

Referring now to FIGS. 1 and 2, there is shown an embodiment having the basic structure of the present invention. Coils 1 are wound on U-shaped pole pieces 2. Said U-shaped pole pieces 2 are arranged at right angles to each other and their leg sections are molded to form a socket space 6 where elongated holder 3 is inserted. Cantilever 4 is resiliently supported in said holder 3 and projects from one end thereof. Cantilever 4 is curved at its tip portion as depicted where stylus 5 is provided. Holder 3, cantilever 4, and stylus 5 forms a stylus assembly. Reference number 7 designates a shielding leaf spring made of non magnetic material, preferably phospher bronze, and is formed with a step portion 8 at its middle portion. Said leaf spring 7 is fixed to pole pieces 2 to extend in their longitudinal direction. The step portion 8 is projected into the socket space 6, and the shielding leaf spring 7 is directly contacted to a cartridge body case, for grounding. Reference number 16 refers to the cartridge body case. When a stylus assembly is inserted, namely, the holder 3 is inserted into the socket space 6, the holder 3 is resiliently pressed by the step portion 8 of the shielding leaf spring 7. Thus, the holder 3 is grounded through the shielding leaf spring 7, and at the same time, pressed to the pole pieces 2 by the leaf spring 7 for a snug fit between the pole pieces 2. Accordingly, the rectangular socket space 6 surrounded by the pole pieces may have a dimension slightly larger than the outer dimension of the holder 3. Said space 6 may have a circular form and also said holder 3 may have a cylindrical form.

Another embodiment of the present invention is shown in FIGS. 3 to 7.

Figure 4:
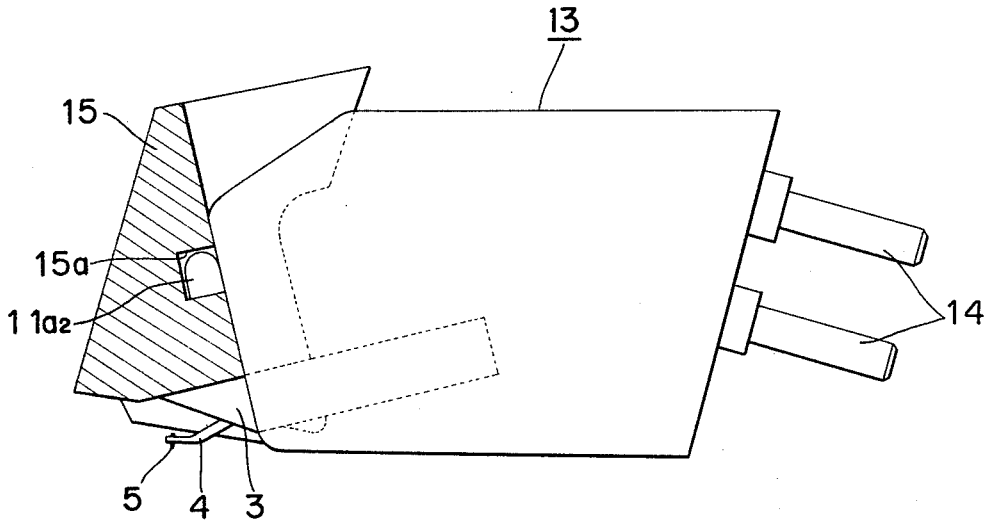
FIG. 4 is an illustration of the positional relationship of the stylus assembly and a cartridge body case used in the embodiment of FIG. 3.

Referring to FIG. 4, cartridge assembly comprises a resin knob 15 to be fitted to a shield case 13 of the cartridge body which will be described later, a holder 3 fixed to the knob 15, a cantilever 4 resiliently held in said holder together with a magnet (not shown), and a stylus 5 attached to the tip of the cantilever 4. The structure of a pickup cartridge mentioned above is known. On the knob 15, a guide hole 15*a* is provided, in which a boss 11*a*$_2$ projecting from the shield case 13 is to be inserted.

Figure 5:
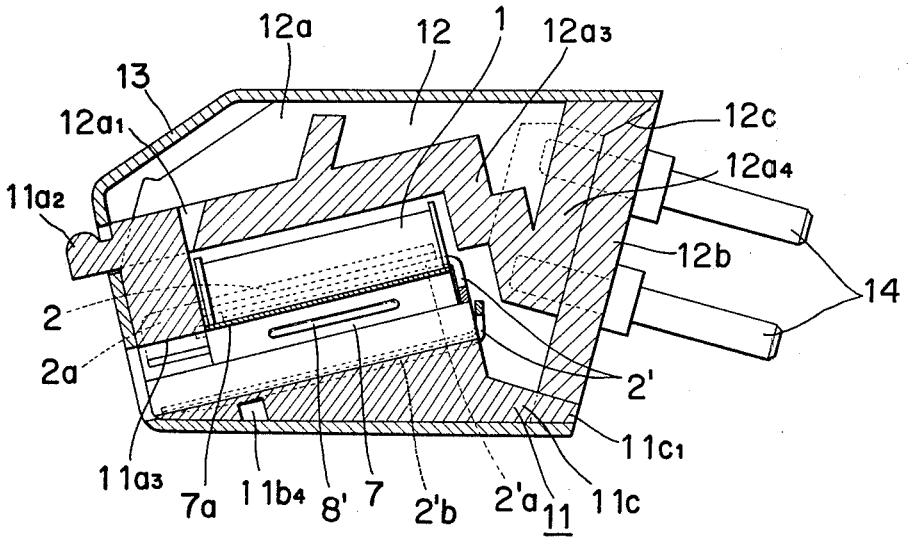
FIG. 5 is a sectional side view of the pickup cartridge of the embodiment of FIG. 3, wherein all the components shown in the figure are assembled.

Referring to FIG. 5, the pickup cartridge body comprises a pickup cartridge unit, a receptacle 12 which protects said pickup cartridge unit and has terminal pins 14 for end wires of coils 1 and a shield case 13 made from magnetic material such as permalloy joining said pickup cartridge unit with said receptacle 12. Said pickup cartridge unit comprises a resin base member 11, a shield leaf spring 7 extending above the horizontal section 11*b* of the base member first pole pieces 2 each of which forms a magnetic head at one end, which head being molded in the vertical section 11*a* of said basemember 11, coils 1 in which said pole pieces 2 are inserted individually, and second pole pieces 2' each of which is inserted in said coil at one end and fitted to an elongated groove 11*b*$_1$ (shown in FIG. 3) on said base member at the other end.

Figure 3:
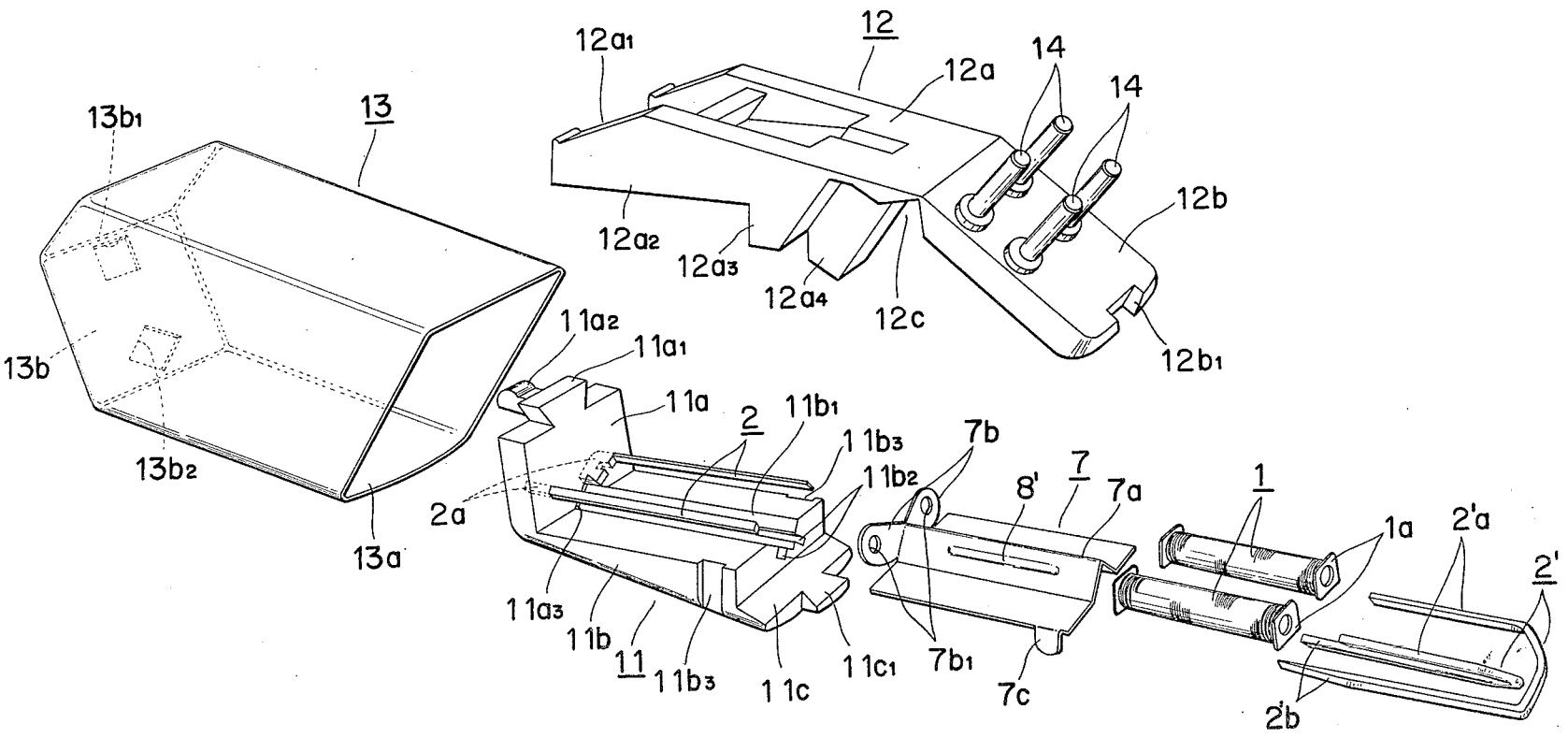
FIG. 3 is an exploded view of another embodiment of the pickup cartridge, wherein a stylus assembly is removed.

The structure of the pickup cartridge unit is described in detail as follows referring to FIG. 3. An L-shaped basemember 11 has a projection 11*a*$_1$ at its top portion, a guide boss 11*a*$_2$ at its front, and a rectangular aperture 11*a*$_3$ at the bottom of the vertical section 5*a* in which said holder 3 is inserted. The base member 11 also has a V-shaped groove 11*b*$_1$ running on the horizontal section 11*b* up to the rectangular aperture 11*a*$_3$ at its center line portion, and two pole piece guide grooves 11*b*$_2$ on both slopes of said V-shaped groove 11*b*$_1$. On each side of of the horizontal section 11*b*, a concavity 11*b*$_3$ is formed to receive tabs 7*c* on a shielding leaf spring 7 which will be described later, and a projection 11*c*$_1$ is provided at the extended end 11*c* of the horizontal section to be meshed with a chamber 12*b*$_1$ of the receptacle 12 which will be described later.

Figure 6:
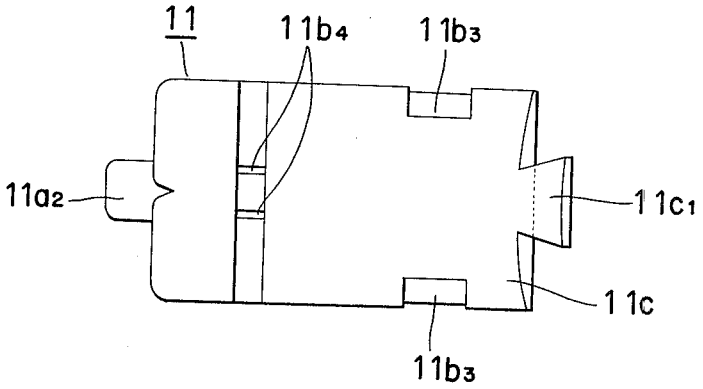
FIG. 6 is a bottom view of the base member shown in FIG. 3.
Figure 7:
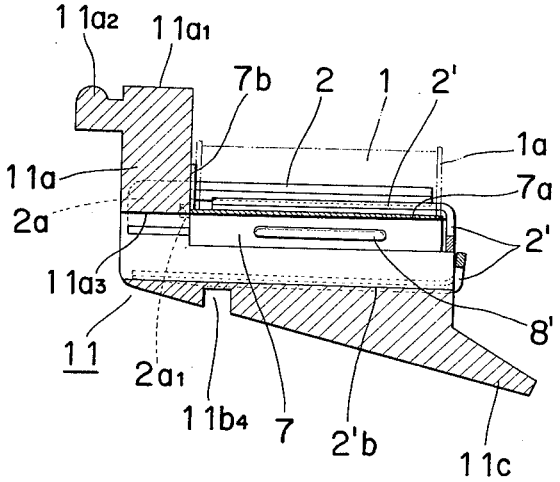
FIG. 7 is a sectional side view of the base member, the pole pieces, the coils, and the leaf spring all assembled in one unit.

Referring to FIG. 6, at the bottom surface of the horizontal section 11*b*, a groove 11*b*$_4$ is provided, into which said pole piece guide grooves 11*b*$_2$ communicate, so that adhesive can be poured into the guide grooves 11*b*$_2$. The first pole pieces 2 are made from magnetic material, and magnetic heads 2*a* are molded in the vertical section 11$_2$ of said base member 11 and partly exposed to the rectangular aperture 11*a*$_3$. Each magnetic head 2*a* has a cut 2*a*$_1$, which is filled with resin when the base member 11 is molded, thus preventing pole pieces 2 from being moved. The length of the first pole pieces 2 is almost the same as that of the horizontal section 11*b*. The shielding leaf spring 7 is made from a non-magnetic electrical conductor and forms a ridge section 7*a* in the longitudinal direction. This ridge section 7*a*, together with the V-shaped groove 11*b*$_1$ on the horizontal section 11*b* of the base member 11, forms a rectangular socket space, in which the holder 3 is inserted. On each side of the ridge section 7*a*, a lug portion 8, projecting inside the rectangular socket space is provided to resiliently press the holder 3 when it is inserted, so that the holder is firmly held in the space and satisfactory contact with the leaf spring can be maintained. The ridge section 7*a* is extended forward and divided to form wing pieces 7*b* with small holes 7*b*$_1$ in them, through which said first pole pieces 2 are to be passed. At the rear corner of the shielding leaf spring 7, tabs 7*c* are formed which mesh with concavities 11*b*$_3$ on said base member 11. Coils 1 are mounted on bobbins 1*a*, which have been formed so that the first pole pieces 2 and second pole pieces 2' can be inserted, and overlapped in the bore of the coil. The second pole pieces 2' are made from magnetic material and formed in U-shape. One pole leg 2'*a* of each second pole piece is inserted in said bobbin 1*a*, and other pole leg 2'*b* is fitted to the pole piece guide groove 11*b*$_2$ of the basemember 11. The structure of the receptacle 12 is described in detail as follows. The receptacle 12 comprises the top section 12*a*, a lid section 12*b*, and a thinly formed hinge section 12*c*. A groove 12*a*$_1$ is formed at the front end of the top section 12*a*, so that it meshes with the projection 11*a*$_1$ on the vertical section 11*a* of said base member 11. The top section 12*a* has vertical sections 12*a*$_2$ locating above the coils 1, lower projections 12*a*$_3$ formed downward at the rear portion of the vertical sections 12*a*$_2$ locating at the end of the coils, and a rear projection 12*a*$_4$ at the rear of the lower projections 12*a*$_3$. On the lid section 12*b*, four terminal pins 14 are provided, to which lead wires running from the coils 1 are connected, and a channel 12*b*$_1$ is formed, which meshes with the projection 11*c*$_1$ on the extended end 11*c* of the base member 11. When the lid section 12*b* is bent at the hinge section 12*c* close to the vertical sections 12*a*$_2$, opposite ends of therminal pins 14 are located at the rear of the lower projections 12*a*$_3$ and at either side of the rear projection 12*a*$_4$. The shielding case 13 is made from a suitable material to provide a barrier to external magnetism, and has an opening 13*a* at the rear end, into which the pickup cartridge unit joined with the receptacle 12 can be inserted. The front panel 13*b* has an aperture 13*b*$_1$ in which the guide boss 11*a*$_2$ formed on the projection 11*a*$_1$ of said basemember 11 is to be inserted, and another rectangular aperture 13*b*$_2$ which matches the rectangular aperture 11*a*$_3$ on the basemember 11.

The method of assembling the structural component parts mentioned above is described as follows.

The first pole pieces 2 molded in the base member 11 at one end are individually, inserted into small holes 7*b*$_1$ of the wing pieces 7*b* on the shielding leaf spring 7 and tabs 7*c* are meshed with respective concavities 11*b*$_3$ of the basemember. Thus, the shielding leaf spring 7 is positioned above the horizontal section 11*b* of the base member 11. The bobbins 1*a* are put on the first pole pieces 2 individually.

Next, a dummy holder, which has been made in same dimensions as the holder 3 and processed so that adhesive does not stick on the surface, is inserted from the rectangular aperture 11*a*$_3$ into the rectangular space formed by the V-shaped groove 11*b*$_1$ and the ridge section 7*a* of the shielding leaf spring 7. At this stage, one end 2'*a* of each second pole pieces 2' is inserted into the bobbin 1*a*, while the other end 2'*b* is fitted to the guide groove 11*b*$_2$ on the basemember 11*b*, so that second pole pieces 2' cross each other.

Next, adhesive is poured into the guide grooves 11*b*$_2$ from the groove 11*b*$_4$ at the bottom of the base member 11. Thus, the ends 2'*b* of the second pole pieces 2' are fixed in the guide grooves 11*b*$_2$, preventing their tips from projecting from the guide groove 11$b_2$. After removing the dummy holder, the holder 3 can be inserted smoothly into the rectangular space without engaging the second pole pieces 2'. The distance between tips of the second pole pieces 2' and the corresponding magnetic heads 2*a* of the primary pole pieces 2 can be correctly maintained. The projection 11$a_1$ on the base member 11 is meshed with the channel 12$a_1$ of the receptacle 12, and the vertical sections 12$a_2$ are placed above the coils 1, then lead wires running from the coils 1 are soldered to the terminal pins 14. Then, the assembly including the base member 11 and the receptacle 12 is put into the shielding case 13 through opening 13*a* and the guide boss 11$a_2$ formed on the projection 11$a_1$ is inserted in the aperture 13$b_1$ of the front panel 13*b*. Thus, the base member 11 is positioned within the shielding case 13, and the rectangular aperture 11$a_3$ of the base member 11 correctly faces the rectangular aperture 13$b_2$ of the shielding case 13. The tabs 7*c* of the shielding leaf spring 7 are in contact with the shielding case 13. Thus, when the shielding case is grounded, the shielding leaf spring is also grounded thereby discharging any static electricity. Resin is poured from the opening 13*a* (taking care to keep the rectangular space clear). After the resin has hardened, the lid section 12*b* of the receptacle 12 is bent at the hinge section 12*c* and the cut 12$b_1$ of lid section 12*b* is meshed with the projection 11$c_1$ on the basement 11. Assembly of the pickup cartridge according to the present invention is thus completed.

As seen from the foregoing description, a resilient member provided in the cartridge, body case to resiliently press the holder of a stylus assembly inserted into socket space defined by pole pieces resilient member ensures a friction fit of the holder of the stylus assembly to the pole pieces. Therefore, the size of the socket space may be slightly larger than that of the holder. This structure makes the insertion of the styles assembly into the cartridge easier without marring the engagement of the holder with the pole pieces. As a result, sufficient contact for grounding can be realized.

Moreover, the damage to the pole pieces or coils provided thereon which is often caused by the insertion and removal of the stylus assembly can be prevented by additionally providing a resilient member to shield the coils from interference from the holder of the stylus assembly.

What is claimed is:

1. A pickup cartridge comprising a stylus assembly having a stylus, a cantilever carrying the stylus on an end portion thereof, and an elongated holder for resiliently holding said cantilever; a cartridge body case of magnetic material, said cartridge body case having an opening for the insertion of the elongated holder therethrough; pole piece means positioned inside of said cartridge body case, said pole piece means having at least two coils wound therearound and leg portions to pick up a signal and transmit the signal to the coils and to define a socket space of substantially a square cross-section, said socket space being in alignment with the opening in the cartridge body case to receive the inserted elongated holder therein; a base member of non-magnetic and non-conductive material, said base member being adapted to rigidly support the pole piece means in position in the cartridge body case; and resilient support means of electro-conductive non-magnetic material, said resilient support means being rigidly supported by the base member within the cartridge body case and projecting into said socket space to support the inserted elongated holder of the stylus assembly and wherein the resilient support means is grounded.

2. A pickup cartridge according to claim 1 wherein said pole piece means includes two pole pieces, each comprising a U-shaped member, said U-shaped members crossing each other at right angles at the bases of the U's thereof.

3. A pickup cartridge according to claim 2, wherein at least one of the legs of said U-shaped pole pieces is wound with one of said at least two coils.

4. A pickup cartridge according to claim 3, wherein the resilient support means is positioned between said one coil of said at least two coils, and said socket space.

5. A pickup cartridge according to claim 4, wherein said resilient support means contacts said pole pieces and is supported thereby.

6. In a pickup cartridge comprising a stylus assembly having a cantilever carrying a stylus on its one end portion, and an elongated holder for holding said cantilever at its other end portion; a cartridge including an L-shaped base member consisting of a horizontal section and a vertical section, said vertical section having an aperture at a lower portion where the horizontal section and the vertical section intersect, said horizontal section having a V-shaped groove at its center line portion extending from said aperture, said V-shaped groove defining a socket space and having guide grooves in both slopes thereof; a pair of first pole pieces extending substantially in parallel with the horizontal section and each first pole piece having one end fixed in the vertical section; a pair of coils engaged around the first pole pieces; a pair of second pole pieces, each pole piece being U-shaped and having one leg inserted into one of the two guide grooves and the other leg inserted in one of the coils: the improvement wherein said cartridge is provided with a resilient member extending for the whole length of the holder socket space and having at least one lug portion protruding downward to resiliently press the inserted holder for securing a fit of the stylus assembly.

* * * * *